United States Patent [19]

Bailey

[11] 4,286,748

[45] Sep. 1, 1981

[54] CENTRIFUGAL CONCENTRATOR

[76] Inventor: Albert C. Bailey, Box 65, Lolo Park Trailer Ct., Lolo, Mont. 59847

[21] Appl. No.: 150,895

[22] Filed: May 19, 1980

[51] Int. Cl.[3] ..... B04B 15/12; B04B 11/00

[52] U.S. Cl. ..... 233/1 D; 233/16; 233/28

[58] Field of Search ..... 233/16, 1 D, 19 R, 19 A, 233/27, 28, 14 A, 14 R, 12, 20 A, 20 R, 34, 38, 41, 29; 366/136, 137, 220

[56] References Cited

U.S. PATENT DOCUMENTS

| | | | |
|---|---|---|---|
| 459,858 | 9/1891 | Seymour | 233/27 |
| 556,567 | 3/1896 | Waring | 233/27 |
| 2,022,926 | 12/1935 | Schlank | 233/27 |
| 2,394,015 | 2/1946 | Schutte | 233/27 |
| 2,472,475 | 6/1949 | Hamilton | 233/27 |
| 2,649,202 | 8/1953 | Jones | 233/27 |
| 2,782,925 | 2/1957 | Morton | 233/28 |

*Primary Examiner*—Robert W. Jenkins
*Attorney, Agent, or Firm*—Georges A. Maxwell

[57] ABSTRACT

A concentrator comprising an elongate vertical upwardly opening drum with an upwardly and radially outwardly inclined side wall and a substantially horizontal bottom wall, means rotatably supporting the drum on a vertical axis, drive means rotating the drum about said axis, a plurality of vertically spaced annular radially inwardly and downwardly inclined baffles at the inside surface of the side wall and cooperating therewith to define a plurality of vertically spaced annular substantially downwardly opening heavy material collecting recesses, a normally closed drain opening at the lower end of the drum, material supply means to deliver particulate material into the drum adjacent the bottom wall and including a vertical material conductor with open upper and lower ends; and irrigating means including a water supply communicating with the upper end of said conductor and delivering water into and through the conductor and vertically spaced nozzles connected with the water supply and arranged within the drum and directing streams of water toward the inside surface of the side wall and onto and through particulate materials at said surface of the side wall.

6 Claims, 3 Drawing Figures

CENTRIFUGAL CONCENTRATOR

This invention has to do with a concentrator for separating the gang and metal values of ore and is particularly concerned with a novel centrifugal concentrator.

BACKGROUND OF THE INVENTION

Most valuable and workable ore contains separable particles of heavy metal values within a matrix of light mineral gang.

In the course of recovering metal from ore, it is common practice to reduce or break the ore down into a fine particulate state or condition by a suitable milling operation and to thereby release the metal values from the gang matrix.

Thereafter, and prior to smelting or otherwise processing the metal values, the values are concentrated, that is, the commingled milled values and gang are worked upon to separate and to remove as much of the gang as is possible and to thereby increase the percentage or concentration of metal values.

The separating of metal values and gang to concentrate the values is commonly carried out by mechanical means and/or devices which are called concentrators. Due to the widely different structural makeup and/or characteristics of different ore, it has been found that a concentrator which is highly effective to concentrate the metal values of one ore is of questionable effectiveness when working on certain other ore and may be totally ineffective to work upon yet another ore. As a result of the foregoing, the prior art is repleat with many different concentrators, few of which can be said to be universally applicable and effective to work upon all or a multiplicity of different ore containing one particular metal value, such as gold, tungsten or silver.

Substantially all concentrators rely upon the difference in specific gravity between the heavy metal values and the light gang of the ore worked upon to effect separation of the materials.

In using or operating most concentrators, the ore worked upon is mixed with copious quantities of water to establish an aqueous slurry in which, by specific gravity displacement, and under the force of gravity, the light gang moves upward to the top of the slurry and the heavy metal values move downward and tend to settle or drop out of the slurry.

Beyond the above, most concentrators serve to control the flow of the slurry or material worked upon and impart motion into the slurry, whereby the above noted specific gravity displacement of materials is enhanced. Most concentrators also operate to cause the separated gang occurring above the heavy metal values to flow separately away from the heavy metal values for disposal and cause the heavy metal values, below the light gang, to flow separately to a place where it collects or is collected for subsequent processing.

As a general rule, concentrators are large, heavy, costly to make and to operate and require the extravagant use of large volumes of water. Further, they are rather slow operating, that is, the rate at which they effect separation and collecting of values sought to be recovered is rather slow.

As a result of the foregoing, few efficient and effective concentrators are portable in nature and few are such that they can be satisfactorily moved from one site to another. Still further, few concentrators provided by the prior art can be economically and effectively used where there is not a large and inexpensive supply of water.

Very frequently ore is heavily ladened with or has a high percentage of garnet. Garnet has a high specific gravity and a hardness as high as 9 and is unique in that when reduced into particulate form, each particle has 7, 9, 11 or 13 flat facets. As a result of the above, when ore containing garnet is mechanically worked upon in most concentrators, the heavy and hard garnet of unique configuration settles out and works into or establishes a dense, structurally stable and substantially stationary layer or bridged garnet particles, through which heavier particulate material such as metal values, cannot migrate and over which such values freely move to evade collection.

As a result of the above, there are numerous known deposits of garnet which are heavily ladened with gold and other metal values, from which the metal values cannot be effectively and economically extracted. In these cases, when the ores are worked upon in efforts to liberate and separate the metal values, the garnet continuously bridges and combines to create barriers which hold the metal values captive and/or direct the values in such a way or manner that they cannot be effectively collected.

OBJECTS AND FEATURES OF THE INVENTION

An object and feature of my invention is to provide an improved concentrator which utilizes centrifugal force to supplement gravity to effect specific gravity displacement of heavy metal values and light gang and to effect collecting of the metal values and the disposal of the gang.

It is another object and feature of my invention to provide a concentrator of the general character referred to above which is such that it can be made notably smaller, more compact and lighter than most concentrators provided by the prior art which have comparable material handling capacities.

Yet another object and feature of my invention is to provide a concentrator of the general character referred to which is such that it requires the use of a notably smaller volume of water than is required for the effective operation of most concentrators provided by the prior art and which is such that the major portion of the water that is used is recycled in and through the constructor whereby the concentrator can be advantageously where water is in short supply.

An object and feature of my invention is to provide a concentrator of the general character referred to above which is made up of few parts, each of which is easy and economical to make and a construction wherein the parts are easy and economical to assemble and to operate. It is an object and feature of my invention to provide a concentrator of the general character referred to which includes an elongate material receiving drum having a radially outwardly and upwardly inclined cylindrical side wall, an open top and a radially outwardly and downwardly inclined bottom wall, means rotatably supporting the drum, drive means to rotate the drum and a plurality of vertically spaced radially inwardly projecting axially downwardly inclined annular baffles on said side wall to stop and collect heavy metal values cast radially outward in the drum and caused to migrate axially upwardly across the side wall thereof, by centrifugal force, and over which light gang, occurring radially inward of the side wall, is free to move upwardly within and from the open top of the drum.

Another object and feature of my invention is to provide a novel concentrator of the general character referred to above having material supply means to deliver milled ore to be worked upon into the bottom of the drum; irrigating means to wash the ore within the drum and including water recovery and recirculating means whereby little water is lost or wasted during operation of the construction.

Another object and feature of my invention is to provide a novel concentrator having novel hydraulic irrigating means which is effective to move and/or separate particles of material, such as garnet, from bridging engagement with each other and to thereby prevent the establishment of strates or layers of bridged materials which impede the separation of the metal values from the gang of the ore worked upon.

The foregoing and other objects and features of my invention will be fully understood and will be apparent from the following detailed description of a typical preferred form and application of my invention, throughout which description reference is made to the accompanying drawing.

DESCRIPTION OF THE INVENTION

Figure 1:
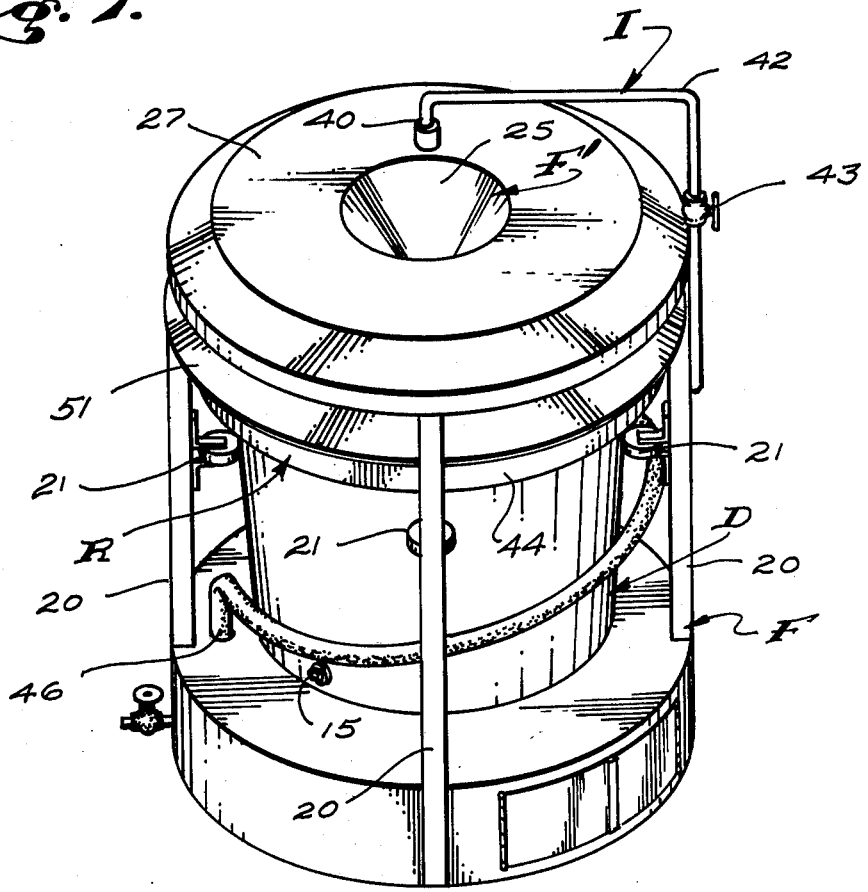
FIG. 1 is an isometric view of my new concentrator.
Figure 3:
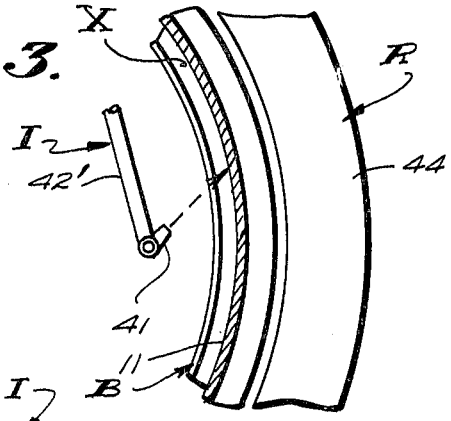
FIG. 3 is a sectional view taken substantially as indicated by line 3—3 on FIG. 2.

The concentrator A that I provide comprises an elongate vertically extending rotatable drum D with a substantially horizontal downwardly and radially outwardly inclined conical bottom wall 10, a substantially vertical upwardly and radially outwardly inclined conical side wall 11 and an open top 12. The open top is defined by a radially inwardly and upwardly and thence radially outwardly and downwardly turned annular weir W about and/or defining the upper rim portion of the side wall 11. The bottom wall 10 is shown inclined at about 10° from horizontal and the side wall 11 is shown inclined at about 10° from vertical. The radially inwardly and upwardly inclined lower inner portion of the weir W projects radially inward from the upper end of the side wall 11 and the radially outwardly and downwardly inclined upper portion of the weir extends radially outward from and beyond the exterior of the drum.

Within the drum and arranged in vertical spaced relationship on and about the inside surface of the side wall 11, is a plurality of annular radially inwardly and axially downwardly inclined annular baffles B. In the embodiment of the invention shown in the drawings, there are three baffles B. The baffles B cooperate with the side wall 11 to define vertically spaced downwardly and radially inwardly opening V-shaped annular grooves X which serve to stop and to collect materials cast radially outward in the drum and which are caused to migrate vertically therein by centrifugal forces generated by rotation of the drum.

In addition to the foregoing, the drum is provided with an elongate central vertical hub H fixed to and depending from the bottom wall 10 and a horizontal driven pulley 14 fixed to the hub.

A normally closed drain plug fitting 15 is provided at the bottom of the side wall 11, adjacent the bottom wall 10.

The upper portion of the side wall 11, adjacent the junction of that wall and the weir W is provided with a plurality of circumferentially spaced, radial water conducting drain openings 16. Within the drum and overlying the drain openings 16 is a filter screen 17.

But for the screen 17, plug 15, hub H and pulley 14, the drum structure described in the foregoing is fabricated of sheet metal. In practice, the various sheet metal parts and/or portions of the drum structure can be formed by spinning and/or drawing processes or by suitable cutting and forming operations as desired or as circumstances require. Further, the various parts and/or portions of the drum structure can be welded together or fixed by suitable mechanical fastening means, as desired.

The drum D is rotatably supported by an antifriction bearing 18 carried by an elongate vertical spindle 18' fixed to and projecting upwardly from a deck or ground-engaging frame F. The spindle 18' projects upwardly into the hub H at the lower end thereof.

The frame F has at least three and preferably four vertically extending columns 20 spaced radially outward of and circumferentially about the exterior of the drum. The columns 20 are provided with stabilizing wheels or rollers 21 of resilient rubber or the like, on vertical axes and engaging the exterior of the drum about the upper portion thereof. The rollers 21 stabilize the drum and maintain it on a fixed axis concentric with the spindle 18'.

The concentrator A next includes a prime mover M with a drive pulley 22. The drive pulley 22 is engaged by a drive belt 23 which is engaged with the driven pulley 14 of the drum D. The prime mover M can be an internal combustion engine or can, as shown, be an electric motor.

With the structure thus far described, it will be apparent that the drum D is rotated relative to the frame F by the prime mover M and is stabilized by the rollers 21.

The concentrator A next includes material supply means S to deliver milled particulate ore containing heavy metal values and light gang into the drum D, at the bottom thereof. The supply means S includes an elongate vertical funnel F with an upper, upwardly divergent upwardly opening conical mouth 25 and a lower downwardly opening tubular neck 26. The funnel is arranged centrally of the drum D with its upper open end above the top of the drum and its lower open end immediately above the center of the bottom wall 10 of the drum; whereby milled ore introduced into the upper end of the funnel is conducted to and is deposited within the drum, at the center of the bottom wall 10 thereof.

It will be apparent that the inclination or conical configuration of the bottom wall 10 of the rotating drum D serves to distribute the ore introduced into the drum radially outwardly and circumferentially of the drum in a substantially uniform manner.

The funnel F of the means S can be carried and/or supported in many different ways and is shown carried by a flat horizontal top panel or wall 27 carried by the upper ends of the columns 20 of the frame F. The top wall 27 overlies the open top and the weir W of the drum D in vertical spaced relationship therewith.

The outer peripheral portion of the top wall 27 is inclined radially outwardly and downwardly at substantially the same angle as the upper outer portion of the weir W and is of such extent and is so arranged that its outer lower edge is on a horizontal plane below the horizontal plane of the upper, inner, rim of the weir W. With such a relationship of parts, material centrifugally cast out of the open top of the drum and over the weir W engages the outer peripheral portion of the top wall 27 and is slowed and directed downwardly by that wall, as it advances radially outward from the concentrator.

In accordance with the above, the top wall 27, in addition to carrying the funnel F of the means S, cooperates with the weir W of the drum D to define an annular material or gang conducting discharge passage and/or a deflecting means to control and suitably direct the movement of gang centrifugally cast from the upper open end 12 of the drum D.

With the structure thus far described, it will be apparent that when the drum D is rotated by the prime mover M and milled ore is fed into the drum through the supply means S, the ore is cast radially outward in the drum, adajcent the bottom wall 10 thereof. As the drum and ore continue to rotate, the high density or heavy metal values displace the light gang and move radially outward to the inside surface of the side wall 11 of the drum. Due to the inclination or conical configuration of the side wall 11 of the drum, the heavy metal values migrate axially upward and are stopped by the baffles B and are caught and collected within the grooves X defined by the baffles. The upward movement of the heavy materials relative to the inside surface of the side wall 11 is rather slow, but serves to transport the light gang occurring radially inward of the side wall 11 upwardly in the drum toward the open top thereof. The weir W of the drum serves to retain or prevent the free flow of materials up and out of the drum and maintains a desired thickness or depth of ore in the drum, below the weir, whereby ore introduced into the bottom of the drum will build to a desired working depth within the drum. When the desired working depth of ore is established in the drum, and as additional ore is introduced into the drum, the newly introduced ore will cause the entire mass or ore within the drum to migrate upwardly toward the open end of the drum. When the ore moves upwardly in the drum, as noted above, the particles turn about and/or exchange position and otherwise work in such a way or manner that displacement of the light materials by the heavy materials and the movement of the heavy materials out to the side wall 11 of the drum is enhanced.

By the time the ore reaches the weir or upper open end of the drum D, most of the free readily collectable heavy metal values have been collected by the baffles and only gang (with captive metal values) is cast out of and away from the concentrator.

In addition to the foregoing, to prevent metal values from becoming airborne and escaping from the concentrator A and to enhance the operation of the concentrator, I provide irrigating means I to wet the ore and wash it down through the funnel F of the means S and into the drum D. The means I further operates to irrigate and wash the ore within the drum.

The irrigating means I includes a first spray nozzle 40 related to the upper open end of the funnel F of the means S and disposed to spray and to wet the ore introduced into the funnel and to flush that ore down through the funnel and into the drum. The water introduced into the drum with the ore, like the heavy metal values, is cast radially outward through the ore to the side wall 11 and serves to wash and carry with it the heavy metal values. When the water is thus cast to the side wall 11 of the drum, it is caused to flow upwardly across the inclined inside surface of the side wall to wash and/or carry the values upward.

The irrigating means I next includes a plurality of vertically spaced nozzles 41 in the drum and disposed to direct streams of water onto the ore distributed about the interior of the drum. The streams of water directed onto the ore in the drum by the nozzles 41 serves to hydraulically dredge and break up bridged particulate material which might otherwise establish a barrier which would prevent desired separation and collection of metal values. The water introduced into the ore in the drum by nozzles 41 also serves to lubricate the particulate materials and induces relative movement and desired specific gravity displacement of those materials within the drum.

It will be apparent that the rotating drum operates like a centrifugal water extractor during operation of the construction and is such that without the second nozzles 41 working to dredge and lubricate the ore, the ore within the drum, spaced radially inward of the side wall 11 thereof, would become substantially dry and would tend to bridge and establish a stationary strata of material over which newly introduced materials would have to travel and upon which newly introduced materials would tend to collect and build. Such drying and collecting and building up of materials in the drum would impede the free upward movement or migration of the lighter gang, would impede their displacement by the heavier values and would prevent or adversely affect the operation of the concentrator.

In the form of the invention illustrated, I have provided three nozzles 41 carried by a vertical water delivery pipe 42 depending into the drum, through and from the open top thereof. Each nozzle 41 is preferably arranged to direct a stream of water at an angle disposed radially radially outwardly and circumferentially counter to the direction of rotation of the drum whereby the mass inertia of the circumferentially moving materials in the drum and the substantially counter directed forces or mass inertia of the streams of water issuing from the nozzles 41 are cumulative. With such a relationship, the volume of water issuing from the nozzles 41 and the pressure or forces required to be imparted into that water, can be maintained at a minimum.

In the form of the invention illustrated, there is one nozzle 41 related to each baffle B. Each nozzle 41 is disposed to direct a stream of water toward the side wall of the drum immediately below or in close proximity to the lower side of its related baffle. The stream of water is adjusted and directed so that after it impinges upon the ore and the side wall of the drum, sufficient diffused water, under sufficient force, is directed upwardly beneath the baffle B to flush out and to maintain that area immdiately below the baffle free of light gang, but not so much water, and water under such pressure as would tend to flush or drive the heavy metal values away and from beneath the baffle.

In practice, the dispositioning of the nozzles 41 must be adjusted and set for most effective working of each ore. Once properly set for effectively working on a particular ore, the nozzles 41 need not be varied. It has been found that once the nozzles are set where near desired results are attained with moderate water pressure, fine adjustment and attaining of most effective results can be attained by suitably increasing or decreasing the water pressure.

With the construction set forth above, the streams of water issuing from the nozzles 41 effectively dredge and break up any bridging material immediately below the baffles B. Thus, any mass or bodies of bridged materials occurring in the drum below the planes where the streams of water are directed, are free to advance and move upwardly in the drum to those positions where they are separated and/or broken up by the streams of water. Accordingly, the bridging up of strates or layers of material in the drum which would adversely affect operation of the construction, is effectively prevented.

Finally, the concentrator A includes water supply and recirculating means R related to the irrigating means I. The means R is established in part by the above noted screen 17 and discharge openings 16 in the drum D and further includes a fresh water supply (not shown), a fresh water supply line 43 extending from the fresh water supply to the first nozzle 40. The line 43 has a manually adjustable flow control valve 44 engaged therein to control the volume and/or rate of flow of water from the nozzle 40 into the funnel F of the means S. The means R next includes an annular catch-basin 45 carried by the frame F in free running clearance about the exterior of the drum D and disposed to collect water centrifugally cast radially outward through openings 16 in the drum. The water collected in the basin 45 is drained from the basin into a settling tank 46 carried by the frame F below the drum. The water drained from the basin 45 into the tank is conducted through a transparent plastic drain tube 47. In the form of the invention illustrated, the tube 47 has at least one portion which is disposed to extend substantially horizontally whereby heavy values in the collected water and flowing through the tube will settle to the bottom side of that tube where it can be visibly monitored by the operator of the construction.

The means R next includes a pump P with an inlet connected with the outlet of the tank 46 by a line 47 and has an outlet connected with the pipe 42 by a line 48. The pump P can be driven by the prime mover M or can be driven by its own motor or prime motor M', as shown in the drawings.

During operation of my concentrator, the pump P is operated continuously to supply water to the nozzles 41 and the volume and/or rate of flow of fresh water to the first nozzle 40 is controlled so that the supply of water in the concentrator is maintained adequate to assure proper and effective washing and flushing of material in and through the concentrator.

In practice, the effectiveness of the concentrator to collect water for recirculation is quite high and is such that the volume of fresh water required to be fed or introduced into the construction is almost negligible when the ore being worked upon is made up of dense nonporous materials and is a relatively small volume compared with the volumes of water required for the effective operation of most other concentrators, when the ore is made up of porous or hygroscopic materials.

Figure 2:
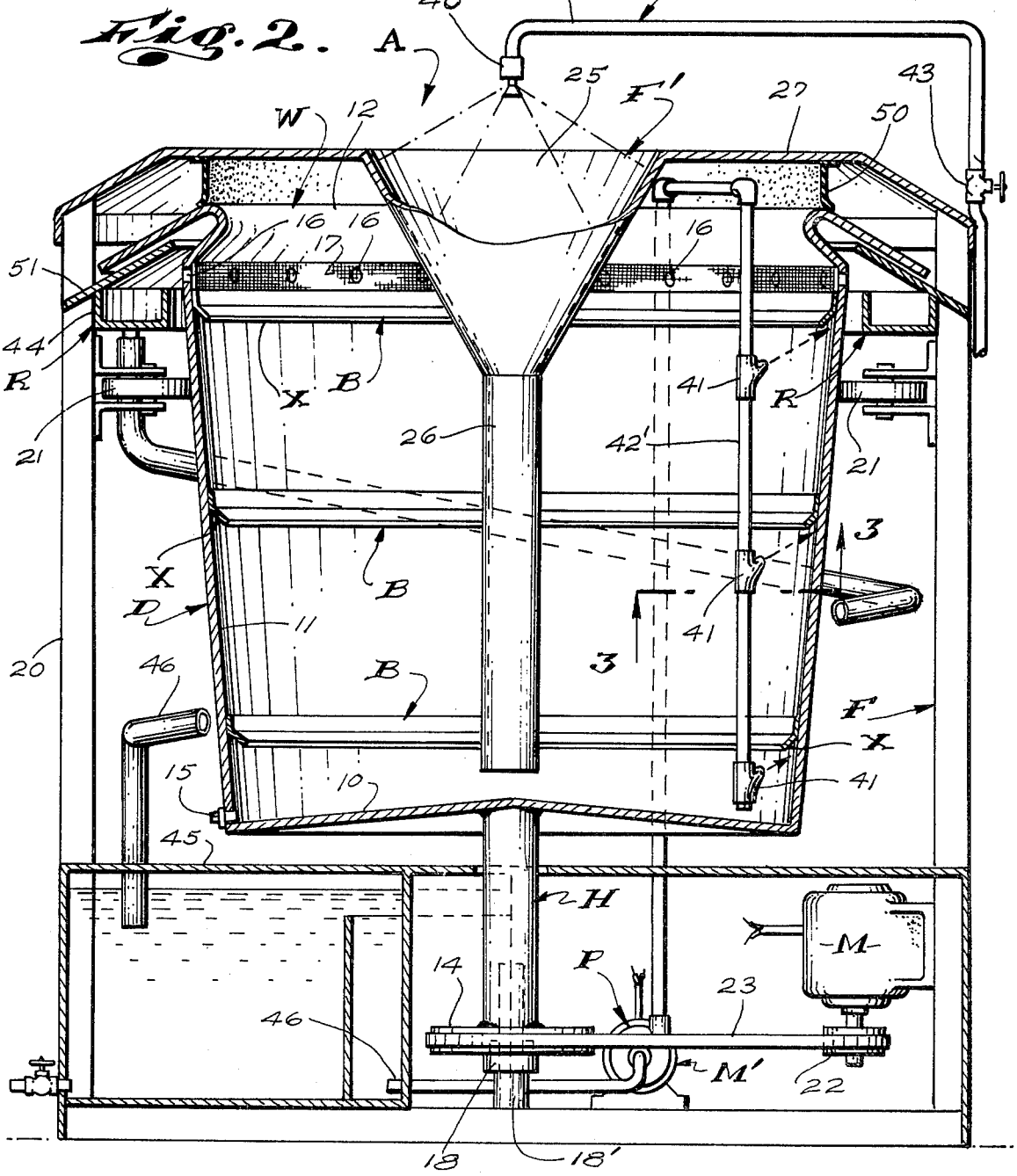
FIG. 2 is an enlarged vertical cross-sectional view of the concentrator shown in FIG. 1.

In the form of the invention illustrated, the catch-basin 44 is fabricated of sheet metal and is carried by the frame F about the upper portion of the drum D, below the upper outer portion of the weir W, substantially as shown in FIG. 2 of the drawings.

In the form of the invention illustrated, the catch-basin 44 is fabricated of sheet metal and is carried by the frame F about the upper portion of the drum D, below the upper outer portion of the weir W, substantially as shown in FIG. 2 of the drawings.

In operation, and after the concentrator has operated a sufficient period of time so that the grooves X defined by the baffles B are substantially filled with metal values, the volume or quantity of metal values migrating over the uppermost baffle and carried by the water into the basin 44 increases markedly. When the quantity of metal values is thus increased, the volume of those values flowing through the transparent tube 46 and settling to the lower side of the substantially horizontal portion of that tube is visibly detected by the operator of the construction. When an increase in the volume of values is seen to exist in the tube 46, the concentrator is turned off or shut down. The plug fitting 15 at the bottom of the drum is opened and the contents of the drum is flushed out of the drum through the open fitting 15 and is suitably collected for subsequent processing.

In practice, striking or rapping the drum D with a heavy tool and maintaining the irrigating system in operation is generally sufficient to effect emptying of the drum of all of its contents.

Subsequent to the last noted emptying or collecting operation, the concentrator can be put back into normal operation until emptying and collecting of values is again required.

In practice, the concentrator must operate for a number of hours and several tons of material must be worked upon before emptying and collecting of values is required. The latter operation normally takes less than five minutes.

In practice, the angle or inclination of the bottom and side walls of the drum D, the number and size of the baffle B and the rotational speed of the drum can be varied and/or adjusted to make the concentrator most effective and efficient for working upon specific kinds of ore. For example, as the difference between the specific gravity of the metal values and the gang of the ore decreases, the rate at which the materials advance through the concentrator must be slowed. In such a case, the angle (from vertical) of the side wall 11 of the drum must be decreased, the speed or rate of rotation of the drum should be increased and the number and radial extent of the baffle can be increased. When the difference of specific gravity of the materials is great and the particulate size of the metal values is large, the rate at which materials advance through the machine must be increased for most economical operation of the concentrator. In such a case, the angle (from vertical) of the side wall 11 of the drum can be increased, the number and/or size of baffles B can be decreased and the speed or rate of rotation of the drum can be adjusted accordingly to effect the proper advancement of materials.

In practice, and as shown in FIG. 2 of the drawings, an annular flexible curtain-like baffle 50 is carried by the top wall 27 to depend down to and normally establish wiping contact with the top of the weir W so that the rotation of the weir relative to the top wall 27 does not tend to pump air and moisture from within the drum and discharge it to atmosphere. The flexible baffle 50 is such that it does not adversely impede the free movement of solid material over and radially outward across the weir. With the baffle 50, the efficiency of the water collecting and/or recirculating means R is greatly enhanced.

In furtherance of the above, the trough 44 is provided with or includes an upwardly and radially inwardly inclined annular deflector plate 51 which projects freely between or in close running clearance with the upper and lower portions of the weir to define a labyrinth type seal whereby no appreciable air pumping action, between the weir and the trough, can take place to rob the construction of valuable water and/or moisture.

In practice, the separating tank 46 is a closed or sealed tank and the tube 47 opens at the bottom thereof below the water level therein. Further, the line 47 extending from the tank 46 to the pump P connects with the bottom of the tank, below the water level therein. With the above relationship of parts, when the pump P is operating and draws water from the tank 46, a minus pressure is created in the tank. The minus pressure thus established in the tank effectively draws water collected in the trough 44 through the tube 46 and into the tank and is effective to prevent the trough from filling and overflowing.

Having described only one typical preferred form and application of my invention, I do not wish to be limited to the specific details herein set forth, but wish to reserve to myself any modifications and/or variations which might appear to those skilled in the art and which fall within the scope of the following claims:

Having described my invention, I claim:

1. A concentrator comprising an elongate vertical upwardly opening drum with an upwardly and radially outwardly inclined side wall and a substantially horizontal bottom wall, means rotatably supporting the drum on a vertical axis, drive means rotating the drum about said axis, a plurality of vertically spaced annular radially inwardly and downwardly inclined baffles at the inside surface of the side wall and cooperating therewith to define a plurality of vertically spaced annular substantially downwardly opening heavy material collecting recesses, a normally closed drain opening at the lower end of the drum, material supply means to deliver particulate material into the drum adjacent the bottom wall and including a vertical material conductor with open upper and lower ends; and irrigating means including a water supply communicating with the upper end of said conductor and delivering water into and through the conductor and vertically spaced nozzles connected with the water supply and arranged within the drum and directing streams of water toward the inside surface of the side wall and onto and through particulate materials at said surface of the side wall.

2. The concentrator set forth in claim 1 which further includes an annular substantially radially inwardly projecting weir about the upper open top of the drum and over which particulate material moving upwardly and out of the drum moves, a plurality of circumferentially spaced water outlet openings in the side wall of the drum below the weir and an annular catch-basin supported about the exterior of the drum radially outward of said openings and collecting water flowing out through those openings.

3. The concentrator set forth in claim 2 which further includes water recirculating means comprising a power driven pump with an inlet connected with said basin and an outlet connected with said water supply.

4. The concentrator set forth in claim 3 which further includes a cover overlying the open top of the drum in spaced relationship with said weir and defining an annular radially outwardly and inwardly opening material discharge passage and an annular vertical flexible curtain in and normally closing said discharge opening to the radial outward flow of water and air and displaceable by radially outwardly moving particulate material.

5. The concentrator set forth in claim 4 wherein said water recirculating means includes a settling tank connected with and between the pump and the basin.

6. The concentrator set forth in claim 5 wherein the settling tank is air-tight and has an inlet opening connected with a water conductor extending to and communicating with the basin and an outlet opening connecting with the pump whereby a minus pressure is generated in the tank by the pump and the minus pressure in the tank draws water through the conductor and from the basin.

* * * * *